United States Patent [19]

Isaac et al.

[11] Patent Number: 4,904,320

[45] Date of Patent: Feb. 27, 1990

[54] METHOD FOR FORMING CHLORINATED LIQUID CENTER OF A WOUND GOLF BALL CORE AND PRODUCT

[75] Inventors: Edward J. Isaac, Acushnet; Joseph P. Lala, Fairhaven, both of Mass.

[73] Assignee: Acushnet Company, New Bedford, Mass.

[21] Appl. No.: 286,371

[22] Filed: Dec. 19, 1988

[51] Int. Cl.[4] ..... A63B 39/00; C09J 5/02

[52] U.S. Cl. ..... 156/146; 156/153; 156/319; 273/222; 273/231

[58] Field of Search ..... 156/80, 97, 145, 146, 156/153, 154, 170, 186, 319; 273/62, 215, 216, 222, 225–229, 231

[56] References Cited

U.S. PATENT DOCUMENTS

| | | | |
|---|---|---|---|
| 1,568,513 | 1/1926 | Lewis | 273/216 |
| 1,622,601 | 3/1927 | Miller | 156/170 |
| 1,904,012 | 4/1933 | Reichard | 156/146 |
| 2,053,450 | 9/1936 | Twiss et al. | 156/186 |
| 2,074,808 | 3/1937 | Rickey | 156/146 |
| 2,078,406 | 4/1937 | Oldham | 156/146 |
| 4,158,378 | 6/1979 | Pearson et al. | 156/97 |
| 4,349,161 | 9/1982 | Carlsson et al. | 242/47.09 |

FOREIGN PATENT DOCUMENTS

| | | | |
|---|---|---|---|
| 2194450 | 3/1988 | United Kingdom | 273/62 |

OTHER PUBLICATIONS

Adhesives Handbook, 1970, p. 250.

*Primary Examiner*—Michael W. Ball
*Assistant Examiner*—Steven D. Maki
*Attorney, Agent, or Firm*—Lucas & Just

[57] ABSTRACT

The center of a wound golf ball is first chlorinated to improve the adhesion between the patch and the envelope. This chlorinated center is then abraded after patching to allow the elastic thread to grip the exterior of the center during winding.

10 Claims, No Drawings

METHOD FOR FORMING CHLORINATED LIQUID CENTER OF A WOUND GOLF BALL CORE AND PRODUCT

This invention relates to golf balls and, more particularly, to an improved method for sealing a liquid-filled center of a three-piece golf ball.

Presently, there are three types of golf balls on the market: one-piece balls, which are solid masses of a rubber material; two-piece balls, which comprise a homogeneous rubber core around which a plastic cover is molded; and three-piece balls. Three-piece balls comprise a cover molded around a wound core. A wound core generally comprises a center which is either solid or liquid around which elastic thread is wound. Conventionally, the liquid center is an envelope which has been filled with a liquid, while the solid center is a homogeneous, spherical mass of resilient material, such as polybutadiene or natural rubber. The three-piece golf ball is conventionally referred to as a wound golf ball.

The size of the liquid center in a wound golf ball varies from about 1 inch (2.54 cm) to about 1⅛inch (2.86 cm), with a typical dimension being about 1-1/16 inch (2.70 cm).

Typically the envelope is a thin-walled, hollow sphere which is filled with air. The wall is about 0.120 inch (0.30 cm) thick. The envelope has a puncture area which measures about 0.300 inch (0.76 cm) in diameter and has a thickness of about 0.120 inch (0.30 cm). Envelopes are usually made of natural rubber.

A wound core with a liquid center is made by injecting liquid into the envelope by means of a hypodermic needle, sealing the puncture hole made by the hypodermic needle in the envelope, freezing the liquid-filled envelope into a solid mass, and winding elastic thread about the frozen envelope. The liquid is selected according to its specific gravity so that the overall weight of the finished golf ball is within the limits prescribed by the United States Golf Association, i.e. no greater than 1.62 ounces (45.93 gm). A typical liquid used is corn syrup, adjusted for specific gravity by the addition of an inert filler. When the liquid is injected into the envelope, the air in the envelope is displaced. Conventionally, the puncture hole is sealed with a one-component patch, typically made of urethane isocyanate, which is catalyzed by an organic catalyst. The catalyzed reaction causes the urethane isocyanate to polymerize and adhere to the wall of the envelope.

A problem faced but not solved by the golf ball manufacturing industry has been the poor adhesion between the liquid-filled rubber envelope and the urethane patch. Poor adhesion between the patch and the center leads to leakage of the liquid out of the center which, in turn, leads to ball distortion and renders the golf balls unplayable. Attempts have been made to solve the adhesion problem, but most have failed.

The applicants have discovered that chlorinating the area adjacent to the puncture hole where the patch is affixed to the envelope causes the adhesion between the patch and the envelope to be greatly increased. Applicants have further discovered that chlorinating the area of the envelope upon which the patch is placed virtually alleviates the poor adhesion problems.

In employing this discovery, the applicants were faced with a problem of how to chlorinate the area adjacent to the puncture hole of the envelope. Chlorinating the whole exterior of the envelope made the envelope too slippery for winding elastic thread about the envelope. Chlorinating only the area directly adjacent to the puncture hole was found to be too difficult.

The applicants have now discovered that by employing a two-step process of first chlorinating the entire envelope followed by a second step of abrading the envelope prior to winding, the problem associated with the slippery exterior of the chlorinated envelope is eliminated while good adhesion is obtained between the patch and the envelope.

The step of chlorinating the envelope must be performed before applying the patch to the envelope and, preferably, before filling the envelope with liquid. The abrading step must be done after chlorinating the exterior of the envelope but before winding the elastic thread about the center and, preferably, after the patch has been affixed to the envelope. More preferably, the process of the present invention comprises the successive steps of: chlorinating the unfilled envelope; filling the envelope with a liquid thereby creating a puncture hole in the envelope; sealing said puncture hole in the envelope; and abrading the exterior of the filled, patched envelope.

The step of chlorinating the exterior of the envelope is accomplished in a conventional manner. Good results have been obtained by subjecting unfilled centers to a chlorine solution. Preferably, the chlorine solution is made by dissolving chlorine gas dissolved in at a chlorine concentration of between about 2700 to about 3300 ppm.

The centers are subjected to the chlorine solution for at least about 0.5 minutes and, more preferably, for about 1 minute when the chlorine concentration is between about 2700 to about 3300 ppm. It has been found that after a few minutes there is no noticeable affect on the envelope with respect to the adhesion between the patch and the envelope. Preferably, the residence time of the envelope in the chlorine solution is between about 0.5 to 2 minutes and, more preferably, about 1 minute when the chlorine solution has a chlorine concentration of between about 2700 to about 3300 ppm. Naturally, the times will vary depending on the concentration of the chlorine solution. It has been found that good results by contacting centers with the chlorine solution in a rotating, smooth-walled drum in which the centers are loaded and a chlorine solution is added to cover the centers. The purpose is to get good exposure of the surface of the envelope to the chlorine solution, and it has been found that baffled sides or an impeller are not needed. This is not to say that such mixing means cannot be used, but merely that such mixing means are not needed.

The smooth-walled drum is about 1 meter in diameter and about 1.75 meters high. It is filled with about 4000 centers and about 17 gallons (65 liters) of an aqueous chlorine solution containing 2700 to 3300 ppm chlorine. The drum is rotated at about 30 rpm for about 1 minute. Good results have been obtained with a tilting barrel finishing machine made by Casalbe, Globe Model 3DM.

Affixing the patch to the envelope is done in a conventional manner. Conventionally, the patch is made of urethane isocyanate to which a conventional organic catalyst is added.

Most preferably, the center is abraded after application of the patch and before freezing the center. An advantage to abrading after patching is that no orientation is necessary for the envelope.

Abrading is accomplished with a conventional food-processing peeling machine such as a Toledo Vegetable Peeler having an internal volume of 1.4 cubic feet (0.04 $m^3$). The abrading surface is carborundum. The peeling machine is operated in a conventional manner. The residence time for the chlorinated, patched center in the peeling machine is about 3 to about 15 minutes. Good results have been obtained with a residence time of about 5 minutes.

These and other aspects of the present invention will be more fully understood with reference to the following examples.

EXAMPLE 1

This example illustrates making a patched envelope in accordance with the present invention. Into a tilting barrel finishing machine, Globe Model 3DM manufactured by Casalbe, 4000 rubber centers measuring approximately 2.54 cm in diameter were loaded. To the loaded barrel, 17 gallons of a chlorine solution containing about 3000 ppm of chlorine were added. The chlorine solution was made from chlorine gas and tap water. The temperature of the chlorine solution was maintained at about 40°-50° F. (5°-10° C.) prior to adding to it to the barrel. A cover was placed over the barrel and the barrel was rotated at about 30 rpm for a period of about 1 minute. After tumbling the centers in the chlorine solution for about 1 minute, the chlorine solution was neutralized and discarded. The centers were then washed, drained and dried. The dried centers were subjected to a conventional filling operation using a hypodermic needle to fill the centers with a corn syrup and water solution. The area punctured by the hypodermic needle was patched in conventional manner using a conventional urethane isocyanate patch material. The polyurethane prepolymer was obtained from Lord Chemical Co. of Erie, Pa. under the trade name Chemglaze. Additionally, the patch material contained a catalyst, a wetting agent and a thinner, all of which were obtained from Lord Chemical Co. The urethane patch was allowed to set for approximately 4 hours prior to placing the patched center into a food-processing peeling machine, a Vegetable Peeler manufactured by Toledo. The peeling machine was a drum having an internal volume of 1.4 cubic feet (0.04 $m^3$). The inside walls of the peeling machine had a rough surface made from carborundum. The peeling machine vibrated such that there was a flow of the centers from the bottom inside of the drum out to the side walls and up the side walls of the drum. The action of the peeling machine along the entire exterior of the envelope abraded the exterior of the envelope. Residence time for the envelope in the drum was about 5 minutes. The peeling machine held about 500 centers.

EXAMPLE 2

This example illustrates the improved adhesion between a patch and an envelope made in accordance with the present invention. Table 1 below illustrates a comparison between an envelope patched in accordance with the present invention and an envelope patched in accordance with the prior art.

TABLE 1

| | Present Invention | Prior Art |
|---|---|---|
| Envelope material | natural rubber | natural rubber |
| Liquid type | corn syrup solution | corn syrup solution |
| Amount of liquid (gm) | 7.6 | 7.6 |
| Filled envelope weight (gm) | 17.5 | 17.5 |
| Patch material | polyurethane | polyurethane |
| Adhesion strength | strong | weak |

EXAMPLE 3

A chlorinated, patched, non-abraded frozen envelope was placed in a conventional winding machine. The elastic thread did not stick to the envelope and a wound core could not be made from the chlorinated center. Next, a chlorinated, patched, abraded frozen envelope made in accordance with the present invention was placed in a conventional winding machine. The thread wound around the center without slipping off.

It will be understood that each and every numerical value which appears in the claims herein is modified by the term "about" if the modifying term "about" does not appear in front of such numerical value.

It will be understood that the claims are intended to cover all changes and modifications of the preferred embodiments of the invention herein chosen for the purpose of illustration which do not constitute a departure from the spirit and scope of the invention.

What is claimed is:

1. A method for forming a liquid center of a wound golf ball core comprising the steps of:

(a) chlorinating an envelope;

(b) injecting a liquid into said envelope to fill said envelope;

(c) patching said envelope; and (d) abrading the entire surface of said chlorinated, liquid-filled patched envelope so as to aid in holding subsequently wound thread.

2. The method of claim 1 wherein the step of chlorinating said envelope is accomplished subjecting said envelope to an aqueous solution of chlorine having between about 2700 to about 3300 ppm chlorine for a chlorination period of between about 0.5 to about 2 minutes.

3. The method of claim 1 wherein said abrading is accomplished in a food-processing-type peeling machine.

4. The method of claim 2 wherein said chlorination period is about 1 minute.

5. The method of claim 2 wherein said envelope is placed into a rotatable drum into which said chlorine solution is placed and said drum containing said envelope and chlorine solution is rotated during said chlorination period.

6. The method of claim 2 wherein said envelope is washed prior to injecting the liquid into said envelope.

7. The method of claim 3 wherein said envelope is subjected to said food-processing-type peeling machine for an abrading period of between about 3 to about 15 minutes.

8. The method of claim 5 wherein said drum is rotated at about 30 rpm.

9. The method of claim 7 wherein said abrading period is about 5 minutes.

10. A liquid-filled center made according to the method of claim 1.

* * * * *

UNITED STATES PATENT AND TRADEMARK OFFICE

CERTIFICATE OF CORRECTION

PATENT NO. : 4,904,320

DATED : February 27, 1990

INVENTOR(S) : Edward J. Isaac et al.

It is certified that error appears in the above-identified patent and that said Letters Patent is hereby corrected as shown below:

Column 4, after Table 1, insert --The patch on the prior art center was removed easily with a tweezers while the envelope patched in accordance with the present invention could not be removed with tweezers.--.

Column 4, line 42, after the word "accomplished" insert --by--.

Signed and Sealed this

Eighteenth Day of June, 1991

*Attest:*

*Attesting Officer*

HARRY F. MANBECK, JR.

*Commissioner of Patents and Trademarks*